US007068960B2

(12) United States Patent
Mizusawa

(10) Patent No.: US 7,068,960 B2
(45) Date of Patent: Jun. 27, 2006

(54) CLEANING DEVICE INCLUDING BRUSH ROLLER WITH HIGH CLEANING PERFORMANCE, IMAGE FORMING APPARATUS AND PROCESS UNIT INCLUDING THE CLEANING DEVICE, METHOD OF REMOVING DEPOSIT, AND METHOD OF FORMING AN IMAGE

(75) Inventor: Hiroshi Mizusawa, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 42 days.

(21) Appl. No.: 10/864,507

(22) Filed: Jun. 10, 2004

(65) Prior Publication Data

US 2005/0019057 A1 Jan. 27, 2005

(30) Foreign Application Priority Data

Jun. 13, 2003 (JP) ..... AP2003-169499

(51) Int. Cl.
*G03G 15/02* (2006.01)

(52) U.S. Cl. ..... 399/100; 399/99; 399/353; 399/357

(58) Field of Classification Search ..... 361/221, 361/225; 399/100, 168, 174, 175, 176, 353, 399/354, 99, 357
See application file for complete search history.

(56) References Cited

U.S. PATENT DOCUMENTS 6,085,062 A 7/2000 Mizuishi et al.
6,128,449 A 10/2000 Zenba et al.
6,144,811 A 11/2000 Ohori et al.
6,144,822 A 11/2000 Yamaguchi et al.
6,148,161 A 11/2000 Usui et al.
6,160,969 A 12/2000 Ishigaki et al.
6,266,501 B1 7/2001 Mizuishi et al.
6,628,903 B1 9/2003 Ohori et al.
6,873,809 B1 * 3/2005 Amemiya et al. ..... 399/100
2003/0039494 A1 2/2003 Shakuto et al.

FOREIGN PATENT DOCUMENTS

EP 1 229 399 A1 8/2002
EP 1 288 738 A2 3/2003

OTHER PUBLICATIONS

Patent Abstracts of Japan, JP 08-095350, Apr. 12, 1996.
Patent Abstracts of Japan, JP 2003-169499, Jun. 13, 2003.
U.S. Appl. No. 10/405,630, filed Apr. 3, 2003, Suda et al.
U.S. Appl. No. 10/610,883, filed Jul. 2, 2003, Ohori et al.
U.S. Appl. No. 10/864,507, filed Jun. 10, 2004, Mizusawa.

* cited by examiner

*Primary Examiner*—Hoang Ngo
(74) *Attorney, Agent, or Firm*—Oblon, Spivak, McClelland, Maier & Neustadt, P.C.

(57) ABSTRACT

A cleaning device includes a brush roller that removes deposit from a surface of a member to be cleaned by rotating due to a movement of the surface of the member. The brush roller includes a rotary shaft element and a brush provided on the rotary shaft element. The brush abuts the surface of the member due to a weight of the brush roller. The brush includes filaments, and the brush roller satisfies the inequation $Y/X \leqq 2.8$, where Y is a diameter (denier) of each of the filaments, and X is a length (mm) of each of the filaments. The filaments slant with respect to a normal direction of the rotary shaft element.

34 Claims, 7 Drawing Sheets

CLEANING DEVICE INCLUDING BRUSH ROLLER WITH HIGH CLEANING PERFORMANCE, IMAGE FORMING APPARATUS AND PROCESS UNIT INCLUDING THE CLEANING DEVICE, METHOD OF REMOVING DEPOSIT, AND METHOD OF FORMING AN IMAGE

CROSS-REFERENCE TO RELATED APPLICATIONS

This application claims priority to Japanese Patent Application No. 2003-169499 filed in the Japanese Patent Office on Jun. 13, 2003, the disclosure of which is incorporated herein by reference.

BACKGROUND OF THE INVENTION

1. Field of the Invention

The present invention relates to a cleaning device that removes toner attached onto a surface of a member to be cleaned, such as a charging member that charges a surface of an image carrier while contacting the surface of the image carrier, and relates to an image forming apparatus and a process unit including the cleaning device. The present invention further relates to a method of removing deposit from a surface of a member to be cleaned, and relates to a method of forming an image.

2. Discussion of the Related Art

A cleaning device for cleaning a desired member has been widely used in machines and apparatuses in various technical fields. For example, an image forming apparatus, such as a copying machine, a printer, a facsimile machine, or other similar image forming apparatuses, includes a cleaning device that cleans a member stained by toner, for example, by use of a brush roller. Examples of such a member to be cleaned include an image carrier, such as a photoreceptor, and a charging member, such as a charging roller configured to charge the photoreceptor while contacting the surface of the photoreceptor.

Published Japanese patent application No. 7-140763 describes a cleaning device using a brush roller that contacts the surface of a member to be cleaned. The brush roller is rotated by a drive device. A brush of the brush roller and the surface of the member to be cleaned each are moved at a particular linear velocity, so that the brush scrapes off toner attached onto the surface of the member.

This type of the conventional cleaning device using a brush roller often needs a drive device for driving the brush roller. Further, the cleaning device needs a device for regulating an amount of intrusion of a brush of the brush roller into a desired member to be cleaned to control permanent deformation of the brush, that is, so-called yield of the brush. The drive device and the device for regulating the intrusion amount of the brush increase the cost of the cleaning device and make the configuration of the cleaning device complicated.

Therefore, it is desirable to provide a cleaning device, an image forming apparatus, and a process unit including the cleaning device that have a low-cost and simple configuration without a drive device for driving a brush roller of the cleaning device and a device for regulating an intrusion amount of a brush of the brush roller, and that controls the permanent deformation of the brush while enhancing cleaning performance of the brush roller.

Further, it is desirable to provide a method of removing deposit from a surface of a member to be cleaned and a method of forming an image while controlling permanent deformation of a brush of a brush roller and while enhancing cleaning performance of the brush roller.

SUMMARY OF THE INVENTION

According to an aspect of the present invention, a cleaning device includes a brush roller configured to rotate and to remove deposit from a surface of a member to be cleaned by following a movement of the surface of the member to be cleaned. The brush roller includes a rotary shaft element and a brush provided on the rotary shaft element. The brush abuts the surface of the member to be cleaned due to a weight of the brush roller. The brush includes filaments, and the brush roller satisfies a following inequation, $Y/X \leqq 2.8$, where Y is a diameter (denier) of each of the filaments, and X is a length (mm) of each of the filaments.

According to another aspect of the present invention, an image forming apparatus includes an image carrier configured to carry an image on a surface of the image carrier, a charging member configured to charge the surface of the image carrier while contacting the surface of the image carrier, a toner image forming device configured to form a toner image on the surface of the image carrier by use of toner, and a cleaning device configured to remove toner attached onto a surface of the charging member. The cleaning device includes a brush roller configured to rotate by following a movement of the surface of the charging member. The brush roller includes a rotary shaft element and a brush provided on the rotary shaft element. The brush abuts the surface of the charging member due to a weight of the brush roller. The brush includes filaments, and the brush roller satisfies a following inequation, $Y/X \leqq 2.8$, where Y is a diameter (denier) of each of the filaments, and X is a length (mm) of each of the filaments.

According to another aspect of the present invention, a process unit for use in an image forming apparatus including a latent image carrier configured to carry a latent image on a surface of the latent image carrier, and a developing device configured to develop the latent image on the latent image carrier with toner, includes at least the latent image carrier, a member to be cleaned that contacts the surface of the latent image carrier, and the above-described cleaning device configured to remove toner attached onto the surface of the member to be cleaned.

According to yet another aspect of the present invention, a method of removing a deposit from a surface of a member to be cleaned includes steps of abutting a brush, which is provided on a rotary shaft element of a brush roller, against the surface of the member to be cleaned due to a weight of the brush roller, and rotating the brush roller by following a movement of the surface of the member to be cleaned. The brush includes filaments, and the brush roller satisfies a following inequation, $Y/X \leqq 2.8$, where Y is a diameter (denier) of each of the filaments, and X is a length (mm) of each of the filaments.

According to yet another aspect of the present invention, a method of forming an image includes steps of charging a surface of an image carrier by contacting a charging member with the surface of the image carrier, forming a toner image on the surface of the image carrier, and removing toner attached onto a surface of the charging member by abutting a brush, which is provided on a rotary shaft element of a brush roller, against the surface of the charging member due to a weight of the brush roller and by rotating the brush roller by following a movement of the surface of the charging member. The brush includes filaments, and the brush roller satisfies a following inequation, $Y/X \leqq 2.8$, where Y is a diameter (denier) of each of the filaments, and X is a length (mm) of each of the filaments.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings.

DESCRIPTION OF THE PREFERRED EMBODIMENTS

Figure 1:
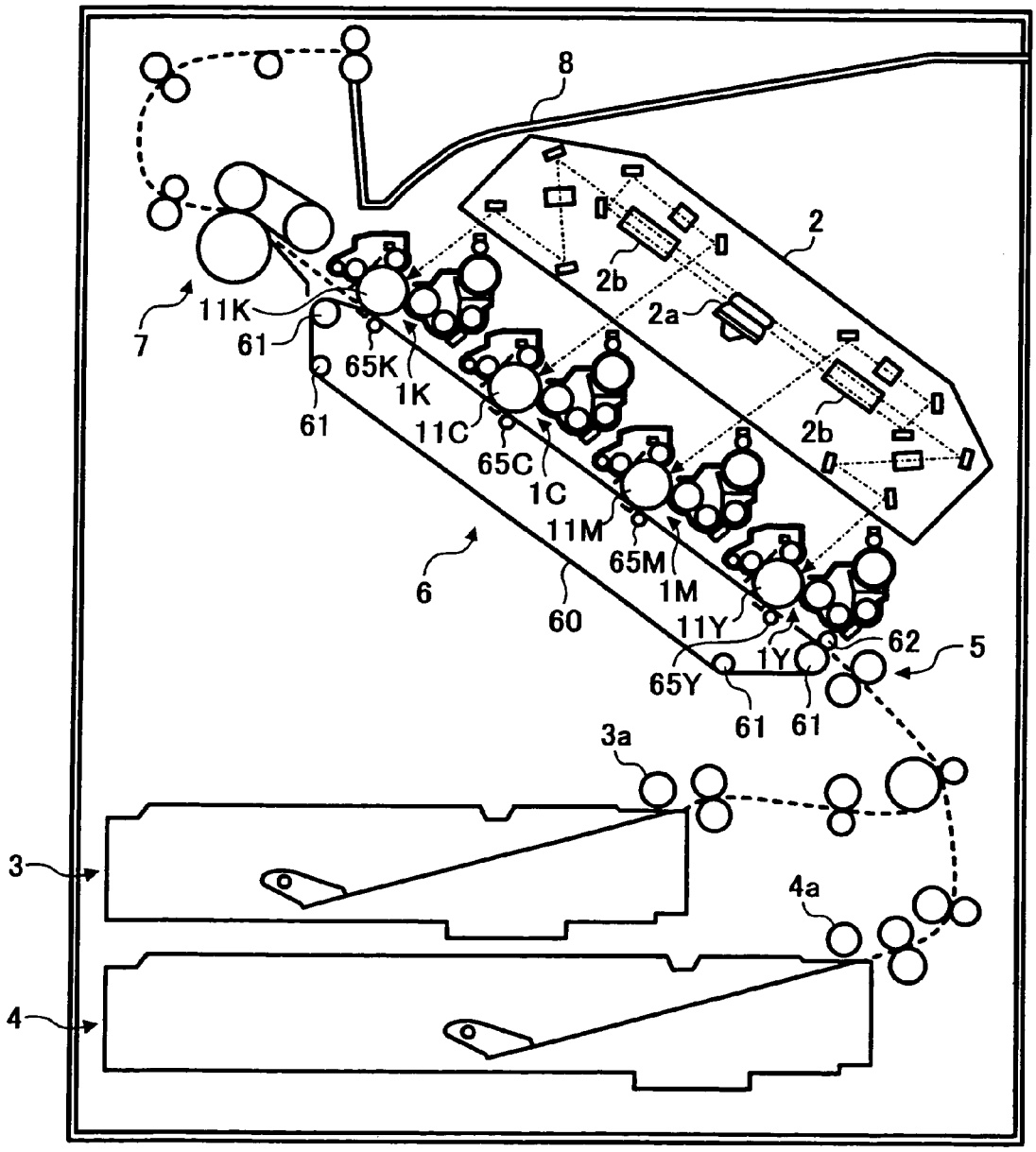
FIG. 1 is a schematic view of a color laser printer according to an embodiment of the present invention.

Preferred embodiments of the present invention are described in detail referring to the drawings, wherein like reference numerals designate identical or corresponding parts throughout the several views. The present invention is applied to a tandem-type color laser printer (hereafter referred to as a "laser printer") as a non-limiting example of an image forming apparatus. First, the basic configuration of the laser printer according to an embodiment of the present invention will be described.

FIG. 1 is a schematic view of a color laser printer according to an embodiment of the present invention. The laser printer of FIG. 1 includes toner image forming units 1Y, 1M, 1C, and 1K that form yellow, magenta, cyan, and black toner images, respectively. The reference letters "Y", "M", "C", and "K" indicate members used for forming a yellow toner image, a magenta toner image, a cyan toner image, and a black toner image, respectively. The toner image forming units 1Y, 1M, 1C, and 1K include image carriers or latent image carriers, such as drum-shaped photoreceptors 11Y, 11M, 11C, and 11K. The laser printer further includes a laser writing unit 2, sheet feeding cassettes 3 and 4, a pair of registration rollers 5, a transfer unit 6, a belt-fixing type fixing unit 7, and a sheet discharging tray 8. The laser printer further includes a manual sheet feeding tray, toner cartridges, waste toner collecting bottles, a duplex/reverse unit, and a power supply unit, all of which are not shown.

The laser writing unit 2 includes a laser light source (not shown), a polygon mirror 2*a*, *f*-theta lenses 2*b*, reflection mirrors, etc., and emits laser beams toward surfaces of the photoreceptors 11Y, 11M, 11C, and 11K, respectively, in accordance with image data.

In the laser printer of FIG. 1, the toner image forming units 1Y, 1M, 1C, and 1K form yellow, magenta, cyan, and black toner images, respectively, and their configurations are substantially the same except for the color of their toner. For this reason, only the configuration and operation of the toner image forming unit 1Y will be described hereinafter.

Figure 2:
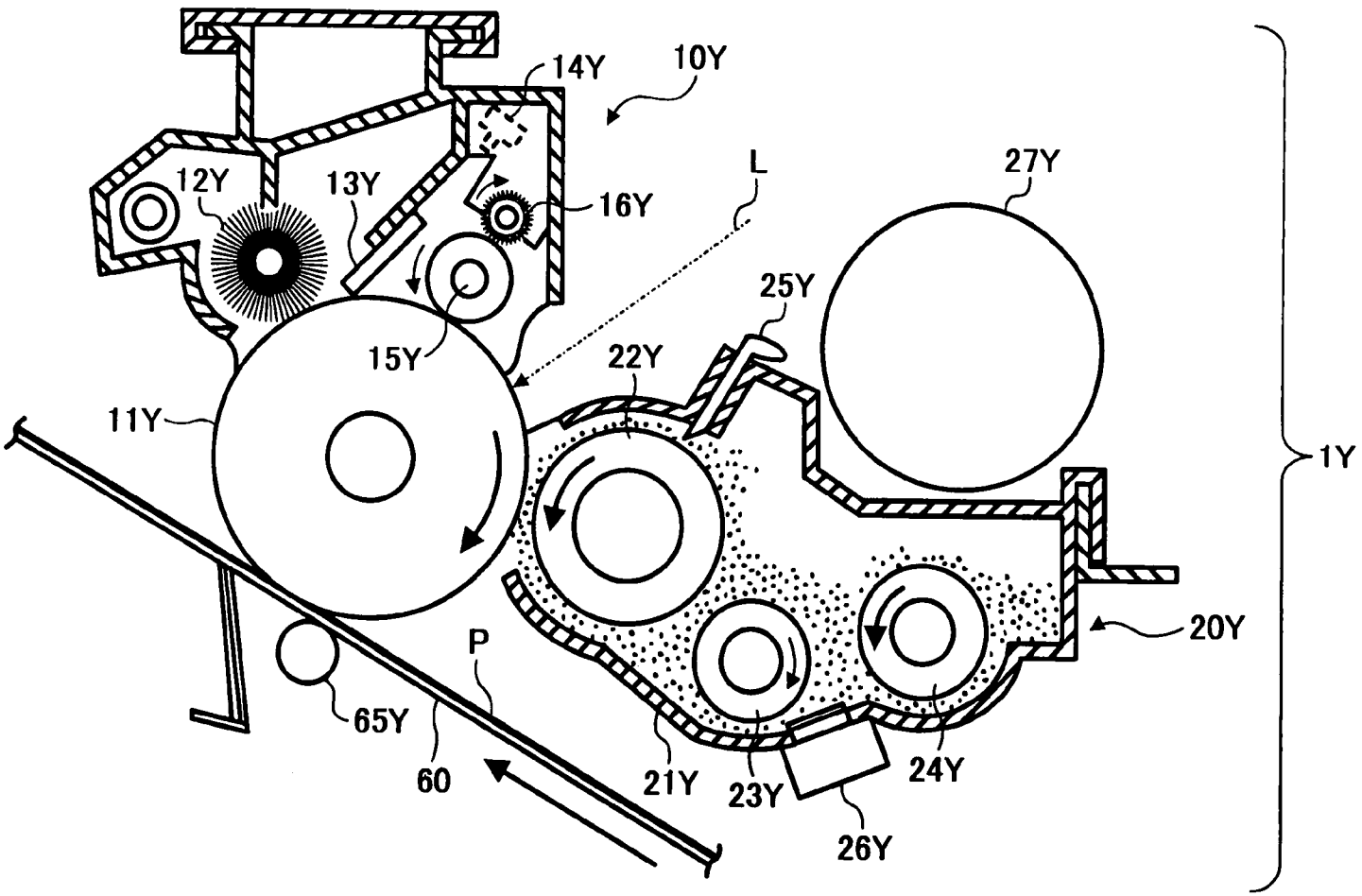
FIG. 2 is an enlarged view of a toner image forming unit that forms a yellow toner image according to an embodiment of the present invention.

FIG. 2 is an enlarged view of the toner image forming unit 1Y that forms a yellow toner image. Referring to FIG. 2, the toner image forming unit 1Y includes a process unit 10Y and a developing device 20Y. The process unit 10Y includes a brush roller 12Y, a counter blade 13Y, and a discharging lamp 14Y, in addition to the photoreceptor 11Y. The brush roller 12Y applies a lubricant onto the surface of the photoreceptor 11Y. The counter blade 13Y is swingable to clean the surface of the photoreceptor 11Y. The discharging lamp 14Y discharges the surface of the photoreceptor 11Y. The process unit 10Y further includes a charging roller 15Y that uniformly charges the surface of the photoreceptor 11Y, and a roller cleaning device 16Y that cleans the surface of the charging roller 15Y. The process unit 10Y may be configured to be detachably attached to the main body of the laser printer of FIG. 1. Elements integrally accommodated in the process unit 10Y are not limited to the above-described elements, and can be different.

In the process unit 10Y, the charging roller 15Y is brought into contact with the photoreceptor 11Y, and is applied with an alternating current bias voltage by a power supply (not shown). The charging roller 15Y uniformly charges the surface of the photoreceptor 11Y while being driven to rotate by a drive device (not shown) such that the moving direction of the surface of the charging roller 15Y is opposite to the moving direction of the surface of the photoreceptor 11Y at a contact part between the charging roller 15Y and the photoreceptor 11Y. After the surface of the photoreceptor 11Y is uniformly charged by the charging roller 15Y, the laser writing unit 2 irradiates the surface of the photoreceptor 11Y with an optically modulated and deflected laser beam (L), thereby forming an electrostatic latent image on the surface of the photoreceptor 11Y. Even if the counter blade 13Y cleans the surface of the photoreceptor 11Y, a small amount of toner, which has not been removed from the surface of the photoreceptor 11Y by the counter blade 13Y, remains on the surface of the photoreceptor 11Y. Such residual toner remaining on the surface of the photoreceptor 11Y attaches onto the charging roller 15Y which rotates while contacting the surface of the photoreceptor 11Y, as a stain. If the stain remains on the charging roller 15, a local charging failure of the photoreceptor 11Y typically occurs due to the residual toner deposited on the charging roller 15Y, thereby causing an abnormal image, such as a black streak image. For these reasons, the roller cleaning device 16Y is provided to remove the toner attached onto the charging roller 15Y.

Figure 3:
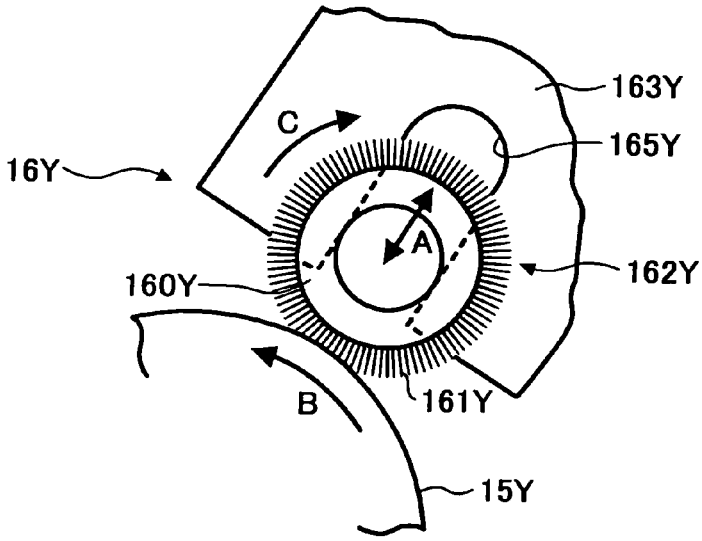
FIG. 3 is an enlarged view of a roller cleaning device in the toner image forming unit of FIG. 2.
Figure 4:
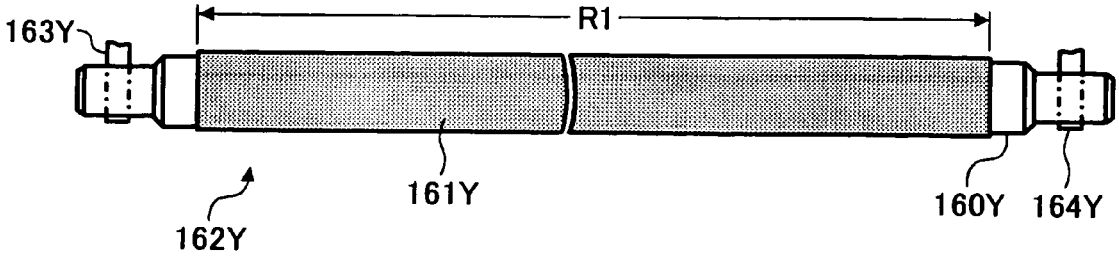
FIG. 4 is a plan view of a brush roller of the roller cleaning device of FIG. 3.

FIG. 3 is an enlarged view of the roller cleaning device 16Y in the toner image forming unit 1Y. As illustrated in FIG. 3, the roller cleaning device 16Y includes a brush roller 162Y constructed from a rotary shaft element 160Y made of a rigid material, such as metal, and hard resin, and a brush 161Y having a number of filaments affixed to the rotary shaft element 160Y at their base portions. The roller cleaning device 16Y further includes two process unit side plates 163Y and 164Y (each hereafter referred to as a "side plate"). The side plates 163Y and 164Y are disposed side by side in the direction perpendicular to the sheet of FIG. 3. Therefore, only the side plate 163Y is illustrated in FIG. 3. The side plate 164Y is illustrated in FIG. 4. The brush roller 162Y is rotatably supported by the two side plates 163Y and 164Y such that the brush roller 162Y is maintained in a parallel relation with the charging roller 15Y.

FIG. 4 is a plan view of the brush roller 162Y. As illustrated in FIG. 4, the brush 161Y extends over the entire circumference of the rotary shaft element 160Y over an axial range "R1" shown in FIG. 4. A cut-away portion 165Y in the shape of a slotted hole is formed in each of the side plates 163Y and 164Y. Axially opposite ends of the rotary shaft element 160Y of the brush roller 162Y are respectively and rotatably received in the cut-away portions 165Y of the side plates 163Y and 164Y. In this position, the rotary shaft element 160Y is slidable along the cut-away portions 165Y in a direction indicated by arrow A in FIG. 3. In this configuration, the brush 161Y of the brush roller 162Y abuts the surface of the charging roller 15Y due to the weight of the brush roller 162Y. Further, the charging roller 15Y rotating in the direction indicated by arrow B causes the brush roller 162Y to rotate in the direction indicated by arrow C in FIG. 3. That is, the brush roller 162Y rotates by following a movement of the surface of the charging roller 15Y. In this condition, the brush 161Y abutting the surface of the charging roller 15Y removes the deposit, such as residual toner, from the surface of the charging roller 15Y. As described above, in the roller cleaning device 16Y, the brush roller 162Y rotates by following a movement of a surface of a member to be cleaned, that is, the charging roller 15Y, while abutting the surface of the charging roller 15Y due to the weight of the brush roller 162Y.

In this configuration, the brush roller 162Y is not driven by a drive device, but is driven by the charging roller 15Y. This obviates the need for an exclusive drive device, thereby simplifying the configuration of the roller cleaning device 16Y while reducing the cost. In a conventional cleaning device using a brush roller, a device for regulating an intrusion amount of a brush of the brush roller regulates an amount of intrusion of the brush of the brush roller into a charging roller by adjusting a relative position between the brush roller and the charging roller such that a distance between an axial center of the brush roller and an axial center of the charging roller is maintained constant. However, such a regulating device increases the cost of the cleaning device and makes the configuration of the cleaning device complicated. By contrast, in the roller cleaning device 16Y of the present embodiment, because the brush roller 162Y abuts the surface of the charging roller 15Y due to its own weight, a desired amount of intrusion of the brush 161Y is obtained just by adjusting the weight of the brush roller 162Y. This configuration eliminates the need for the conventional regulating device and allows the roller cleaning device to have a low-cost and simple configuration.

As illustrated in FIG. 2, the developing device 20Y includes a developer carrier, such as a developing roller 22Y disposed such that a part of the developing roller 22Y is exposed to the outside through an opening formed in a developing case 21Y. The developing roller 22Y includes a cylindrical-shaped developing sleeve (not shown) made of conductive and non-magnetic materials and driven to rotate by a drive device (not shown), and a magnet roller (not shown) fixed at a position inside of the developing sleeve. The developing device 20Y further includes a first developer conveying screw 23Y, a second developer conveying screw 24Y, a doctor blade 25Y, a toner density sensor 26Y (hereafter referred to as a "T sensor"), and a powder pump 27Y.

The developing case 21Y accommodates a two-component developer including magnetic carrier and negatively charged yellow toner. After the two-component developer is charged by friction while being agitated by the first and second developer conveying screws 23Y and 24Y, the two-component developer is conveyed by the first and second developer conveying screws 23Y and 24Y, and is then carried on the surface of the developing roller 22Y. Specifically, the developing roller 22Y carries the developer on its surface while attracting the developer onto a surface of the developing sleeve by a magnetic force generated at the magnet roller. At this time, the doctor blade 25Y regulates a height of the developer on the developing roller 22Y. Subsequently, when the regulated developer is carried to a developing region where the developing roller 22Y faces the photoreceptor 11Y, the yellow toner in the developer is electrostatically attracted to an electrostatic latent image formed on the surface of the photoreceptor 11Y. Thereby, the electrostatic latent image is developed as a yellow toner image. The two-component developer in which yellow toner is consumed for developing the electrostatic latent image on the photoreceptor 11Y, is returned into the developing case 21Y by the rotation of the developing roller 22Y. The yellow toner image formed on the photoreceptor 11Y is transferred onto a transfer sheet P conveyed by a transfer conveying belt 60 (described below).

The T sensor 26Y formed from a magnetic permeability sensor is attached onto a bottom plate of the developing case 21Y and is configured to output a voltage value corresponding to the magnetic permeability of the developer conveyed by the first developer conveying screw 23Y. Because the magnetic permeability of the developer is in correlation with the toner density of the developer, the T sensor 26Y outputs a voltage value corresponding to the density of yellow toner. The data of the voltage value output from the T sensor 26Y is transmitted to a control device (not shown). The control device includes a storage device, such as a random-access memory (RAM). The storage device stores data of respective target output voltage values (Vtref) of the T sensors provided in the toner image forming units 1Y, 1M, 1C, and 1K, respectively. In the case of using yellow toner, the control device compares the voltage value output from the T sensor 26Y with the target output voltage value (Vtref). Then, the control device drives the powder pump 27Y connected to a yellow toner cartridge (not shown) for a predetermined period of time based on the comparison result. Thereby, the yellow toner accommodated in the yellow toner cartridge is supplied into the developing case 21Y through the powder pump 27Y. Thus, the density of yellow toner in the developer in the developing device 20Y is maintained within a predetermined range by supplying an adequate amount of yellow toner into the developer in which the yellow toner is consumed in a developing process. Such a toner supply control is similarly performed in each of the developing devices other than the developing device 20Y in the toner image forming units 1M, 1C, and 1K.

Thus, the toner image forming units 1Y, 1M, 1C, and 1K form toner images of different colors on the photoreceptors 11Y, 11M, 11C, and 11K, respectively, in cooperation with the laser writing unit 2. In the laser printer according to the embodiment of the present invention, the toner image forming units 1Y, 1M, 1C, and 1K and the laser writing unit 2 construct a toner image forming device that forms a toner image on a surface of a photoreceptor by use of toner.

Referring back to FIG. 1, the laser printer includes the sheet feeding cassettes 3 and 4 below a main body thereof.

Each of the sheet feeding cassettes 3 and 4 accommodates a stack of transfer sheets (not shown). Further, each of sheet feeding rollers 3*a* and 4*a* presses against the uppermost transfer sheet. When the sheet feeding roller 3*a* or 4*a* is driven to rotate at a predetermined timing, the uppermost transfer sheet is fed out from the sheet feeding cassette 3 or 4 toward a nip part between the registration rollers 5 through a sheet conveying path. The registration rollers 5 feed out the transfer sheet toward the transfer unit 6 in synchronization with the rotation of the photoreceptor 11Y at a timing such that the yellow toner image formed on the photoreceptor 11Y is aligned with the transfer sheet.

The transfer unit 6 includes the endless transfer conveying belt 60 that contacts the photoreceptors 11Y, 11M, 11C, and 11K and forms four transfer nip parts between the transfer conveying belt 60 and the photoreceptors 11Y, 11M, 11C, and 11K. As illustrated in FIG. 1, the transfer conveying belt 60 is spanned around four support rollers 61. One of the support rollers 61 located at the rightmost side in FIG. 1 faces an adsorbing bias applying roller 62 to which a predetermined bias voltage is applied from a power supply (not shown). The transfer sheet is electrostatically adsorbed to a front (i.e., an outer) surface of the transfer conveying belt 60 by applying an adsorbing bias to the transfer conveying belt 60 from the adsorbing bias applying roller 62.

Transfer bias applying rollers 65Y, 65M, 65C, and 65K, which contact a rear (i.e., an inner) surface of the transfer conveying belt 60, are provided below the four transfer nip parts, respectively. Transfer biases subjected to a constant-current control are applied to the transfer bias applying rollers 65Y, 65M, 65C, and 65K, respectively, from a transfer bias power supply (not shown). Thereby, a transfer charge is applied to the transfer conveying belt 60, and a transfer electric field having a predetermined intensity is formed between the transfer conveying belt 60 and the surface of the photoreceptor at each transfer nip part. As described above, the laser printer of the present embodiment uses the transfer bias applying rollers 65Y, 65M, 65C, and 65K as transfer bias applying members. In place of the transfer bias applying roller, a transfer bias applying brush or a transfer bias applying blade may be used as the transfer bias applying member.

A transfer sheet conveying path is indicated by dotted lines in FIG. 1. A transfer sheet (not shown) fed out from one of the sheet feeding cassettes 3 and 4 is conveyed by sheet conveying rollers while being guided by guide plates (not shown) toward the nip part between the pair of registration rollers 5. Then, the transfer sheet, which has been fed out by the registration rollers 5 at a predetermined timing, is held on the transfer conveying belt 60 and sequentially passes through the four transfer nip parts. While the transfer sheet sequentially passes through the four transfer nip parts, yellow, magenta, cyan, and black toner images respectively formed on the photoreceptors 11Y, 11M, 11C, and 11K are sequentially transferred onto the transfer sheet at respective transfer nip parts under the influence of the transfer electric field and nip pressure such that the toner images of different colors are superimposed on one another. As a result, a full-color image is formed on the transfer sheet.

The transfer sheet having the fill-color image is conveyed to the fixing unit 7 including a heating roller. After the full-color image is fixed onto the surface of the transfer sheet by the fixing unit 7, the transfer sheet is discharged to the sheet discharging tray 8.

Referring to FIG. 2, a predetermined amount of the lubricant is applied onto the surface of the photoreceptor 11Y by the brush roller 12Y after the yellow toner image is transferred from the photoreceptor 11Y onto the transfer sheet. Subsequently, the counter blade 13Y removes residual toner remaining on the surface of the photoreceptor 1Y therefrom. Then, the surface of the photoreceptor 11Y is discharged by the light emitted from the discharging lamp 14Y, and is prepared for a next electrostatic latent image formation.

Next, a characteristic configuration of the laser printer according to the embodiment of the present invention will be described. Referring to FIG. 3, if the brush 161Y significantly intrudes into the charging roller 15Y, the filaments of the brush 161Y deteriorate soon and permanently deform, i.e., yield. For this reason, an amount of intrusion of the brush 161Y into the charging roller 15Y (hereafter referred to as "an intrusion amount of the brush 161Y") needs to be confined in an adequate range. Specifically, the amount of intrusion (I) of the brush 161Y into the charging roller 15Y is obtained by the following equation, $$I=(R1+R2)-D,$$

where R1 is a radius of the charging roller 15Y, R2 is a radius of the brush roller 162Y, and D is a distance between the rotation center of the charging roller 15Y and the rotation center of the brush roller 162Y. If the weight of the brush roller 162Y is significantly decreased to reduce the intrusion amount of the brush 161Y, the brush 161Y may not efficiently scrape off the toner attached onto the surface of the charging roller 15Y, thereby causing the residual toner to be gradually deposited on the surface of the charging roller 15Y. As a result, an abnormal image typically occurs.

To solve the above-described problems, the laser printer according to the embodiment of the present invention uses the brush roller 162Y that satisfies the following inequation, $$Y/X \leqq 2.8 \quad (1),$$

where Y is a diameter (denier) of each of the filaments of the brush 161Y, and X is a length (mm) of each of the filaments rising from the surface of the rotary shaft element 160Y.

The length (X) of each of the filaments of the brush 161Y rising from the surface of the rotary shaft element 160Y means the length of each of the filaments excluding the portion affixed to the rotary shaft element 160Y at its base portion. One denier is a unit as to the size of a fiber element, that is, one denier is a size of the fiber element having one gram in weight and 9,000 m in length.

The inequation (1) is determined based on the results of the experiments carried out by the present inventor. To examine the cleaning performance of the brush roller 162Y, a plurality of the brush rollers 162Y were prepared in which diameter (Y) and length (X) of each of filaments of the brush 161Y were adjusted to various values. The material of the brush 161Y was selected from one of nylon (Young's modulus: 200–450 kg/mm2), acetate (Young's modulus: 350–550 kg/mm2), and polyester (Young's modulus: 1100–2000 kg/mm2). The conditions were as shown in Table 1:

TABLE 1

| Toner | Negatively charged toner prepared by a polymerization method |
|---|---|
| Diameter of the photoreceptor | 30 mm |
| Charging potential of the photoreceptor | −950 V |
| Electric potential of an electrostatic latent image on the photoreceptor | −140 V |

TABLE 1-continued

| Toner | Negatively charged toner prepared by a polymerization method |
|---|---|
| Developing bias (surface potential of the developing roller) | −650 V |
| Linear velocity of the photoreceptor | 150 mm/sec |
| Diameter of the charging roller | 14 mm |
| Diameter of a core metal portion of the charging roller | 8 mm |
| Material of the surface of the charging roller | DPDM (Ethylene Propylene Diene Methylene Linkage) |
| Linear velocity of the charging roller | 150 mm/sec |
| Charging bias value | −1700 V |
| Diameter of the brush roller | 7.2 mm |
| Diameter of the rotary shaft element of the brush roller | 6 mm |
| Length of the filaments of the brush | 0.6 mm |
| Weight of the brush roller | 69 g |
| Angle of the cut-away portion formed in the side plate | 48 degrees |

To examine the occurrence of an abnormal image, such as a black streak image, caused by the deposit (i.e., stain) on the surface of the charging roller 15Y, a reference yellow image having an image area ratio of 25% relative to an A4 size sheet was printed on an A4 size sheet, and 40,000 prints in total were produced under the above-described experimental conditions.

Figure 5:
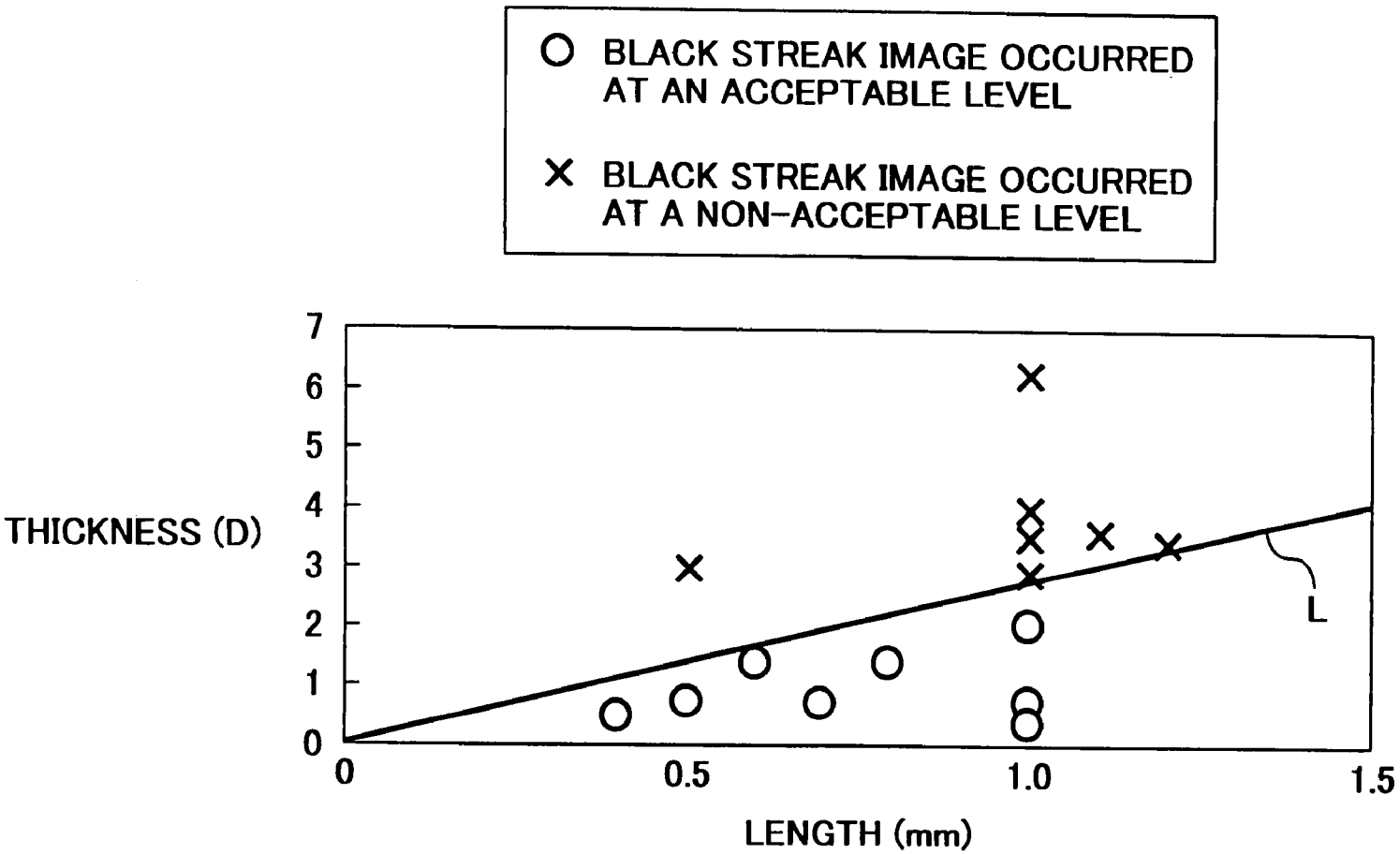
FIG. 5 is a graph showing a relationship between diameter and length of each of filaments of a brush and an occurrence of black streak image based on experimental results.

FIG. 5 is a graph showing a relationship between the diameter (Y) and length (X) of each of filaments of the brush 161Y and an occurrence of black streak image based on experimental results. In FIG. 5, a circle mark indicates that the black streak image occurred at an acceptable level, and a cross mark indicates that the black streak image occurred at a non-acceptable level. As seen from the graph of FIG. 5, the black streak image tends to occur as the diameter (Y) increases and the length (X) decreases. An approximate line (L) was obtained by determining a plurality of boundary points between the acceptable level and the non-acceptable level and by performing a regression analysis on the determined points. The approximate line (L) is expressed by the following equation, $$Y/X=2.8 \quad (2),$$

where Y is a diameter (denier) of each of the filaments of the brush 161Y, and X is a length (mm) of each of the filaments rising from the surface of the rotary shaft element 160Y.

As seen from FIG. 5, the black streak image of a non-acceptable level typically occurred in an area above the level of the approximate line (L). Thus, by satisfying the above-described inequation (1), the cleaning performance of the brush roller 162Y can be enhanced without increasing the weight of the brush roller 162Y, and thereby the occurrence of the black streak image can be effectively controlled.

If the brush roller 162Y satisfies the inequation of X/Y>2.8, black streak images typically occur. The reason for this is considered that because the brush 161Y is significantly hard, the brush 161Y may not have a proper elasticity necessary for scraping toner off the surface of the charging roller 15Y.

In the laser printer according to the embodiment of the present invention, the length of each of the filaments of the brush 161Y rising from the surface of the rotary shaft element 160Y, that is, the length of each of the filaments excluding the portion affixed to the rotary shaft element 160Y at its base portion, is set approximately 2 mm or less. By setting so, the brush 161Y successfully reduces a bending moment exerted on the base portions of the filaments of the brush 161Y when the brush 161Y elastically bends by abutting the surface of the charging roller 15Y. Thus, the yield or permanent deformation of the brush 161Y can be controlled over a long time period, so that the useful lifetime of the brush roller 162Y can be extended.

Further, in the laser printer according to the embodiment of the present invention, the brush 161Y is provided on the circumferential surface of the rotary shaft element 160Y such that the density of the filaments of the brush 161Y is approximately 10,000 filaments/cm2 or greater. By setting so, a great number of filaments contact the charging roller 15Y with the result that the load acting on the individual filament decreases. Thus, the yield or permanent deformation of the brush 161Y can be controlled over a long time period. Further, the great number of filaments abutting the charging roller 15Y can efficiently clean (i.e., remove residual toner from) the surface of the charging roller 15Y, thereby insuring high image quality.

Figure 6:
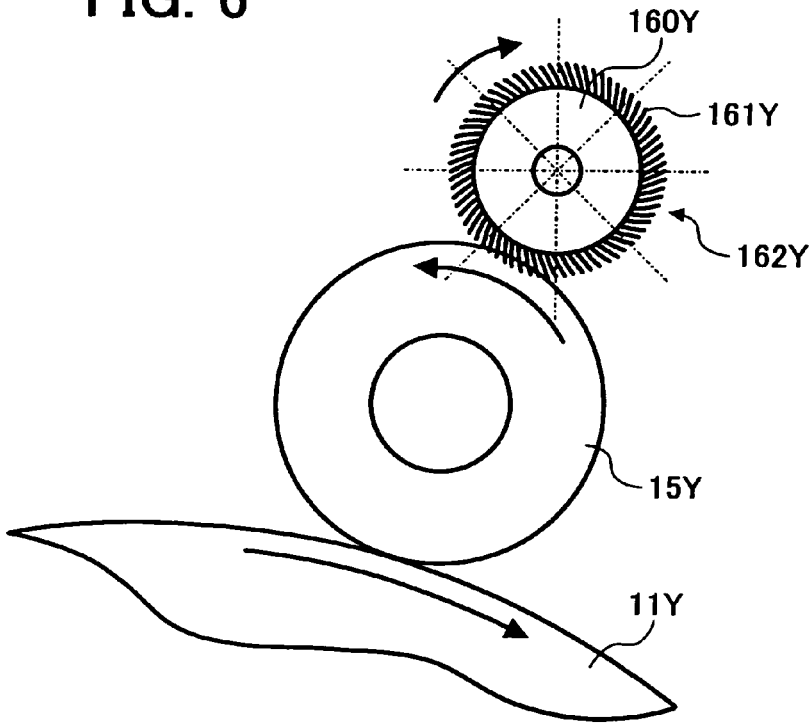
FIG. 6 is a schematic view of the brush roller in which each of the filaments of the brush is slanted backwardly.
Figure 7:
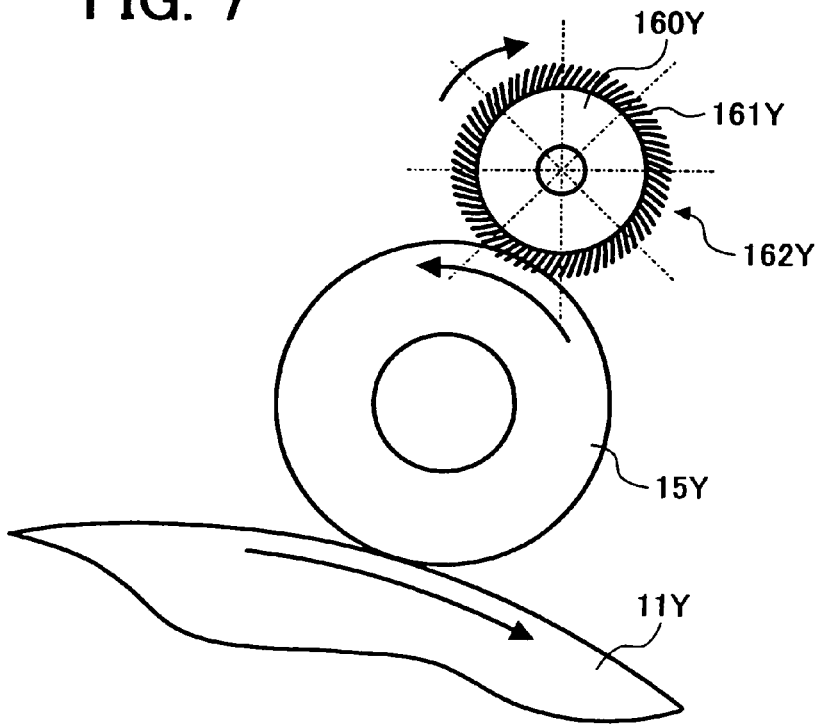
FIG. 7 is a schematic view of the brush roller in which each of the filaments of the brush is slanted forwardly.

As described above, it is preferable that the brush roller 162Y satisfies the above-described inequation (1). In addition, it is preferable that the brush roller 162Y is provided such that each of the filaments of the brush 161Y slants relative to the normal direction in the rotation orbit of the rotary shaft element 160Y as illustrated in FIGS. 6 and 7. In FIGS. 6 and 7, the normal direction in the rotation orbit of the rotary shaft element 160Y is indicated by dashed lines. FIG. 6 illustrates the brush roller 162Y in which each of the filaments of the brush 161Y slants to the upstream side relative to the normal direction of the rotary shaft element 160Y in the moving direction of the surface of the charging roller 15Y. Specifically, as illustrated in FIG. 6, as compared to the base portion of each of the filaments of the brush 161Y, the tip portion thereof is located at the upstream side relative to the normal direction of the rotary shaft element 160Y in the moving direction of the surface of the charging roller 15Y. Further, FIG. 7 illustrates the brush roller 162Y in which each of the filaments of the brush 161Y slants to the downstream side relative to the normal direction of the rotary shaft element 160Y in the moving direction of the surface of the charging roller 15Y. Specifically, as illustrated in FIG. 7, as compared to the base portion of each of the filaments of the brush 161Y, the tip portion thereof is located at the downstream side relative to the normal direction of the rotary shaft element 160Y in the moving direction of the surface of the charging roller 15Y. Hereinafter, the slant of the filaments of the brush 161Y illustrated in FIG. 6 will be referred to as a "backward slant", and the slant of the filaments of the brush 161Y illustrated in FIG. 7 will be referred to as a "forward slant".

Next, the reason for slanting the filaments of the brush 161Y as above will be described. Experiments were conducted by using three kinds of the brush rollers 162Y. The first brush roller 162Y included the filaments of the brush 161Y each of which extended straight in the normal direction without slanting (hereafter referred to as a "straight brush roller"). The second brush roller 162Y included the filaments of the brush 161Y which were backwardly slanted as illustrated in FIG. 6. The third brush roller 162Y included the filaments of the brush 161Y which were forwardly slanted as illustrated in FIG. 7. To compare the cleaning performance of the above-described three brush rollers 162Y, the following experiments were carried out.

First, the surface of the charging roller 15Y was forcibly stained by repeatedly printing a reference yellow image having an image area ratio of 25% relative to an A4 size sheet on 5 sheets of A4 size in the laser printer from which the brush roller 162Y is detached. At this time, the toner density on the surface of the charging roller 15Y was 0.14. The toner density was measured by attaching a transparent tape having a thickness of 0.05 mm, such as one sold under the trademark Printac made by Nitto Denko Corporation, to the charging roller 15Y to transfer the residual toner from the charging roller 15Y to the transparent tape. Subsequently, the density of the toner on the tape was measured by a reflection densitometer, such as one sold under the trademark X-Rite 508 made by X-Rite Corporation. Then, each of the above-described three brush rollers 162Y was attached to the laser printer, and the above-described reference yellow image was repeatedly printed on the predetermined number of sheets. The density of toner on the charging roller 15Y was measured every time the predetermined number of prints were obtained while using each of the three brush rollers 162Y. In view of necessity for transferring the residual toner from the charging roller 15Y to the transparent tape, the toner density measuring position on the charging roller 15Y was shifted every time the measurement was performed. Each of the three brush rollers 162Y weighed about 69 g. In the forward slant and backward slant brush rollers 162Y, each of the filaments of the brush 161Y slanted relative to the normal direction of the rotary shaft element 160Y by an angle of about 60 to 80 degrees.

Figure 8:
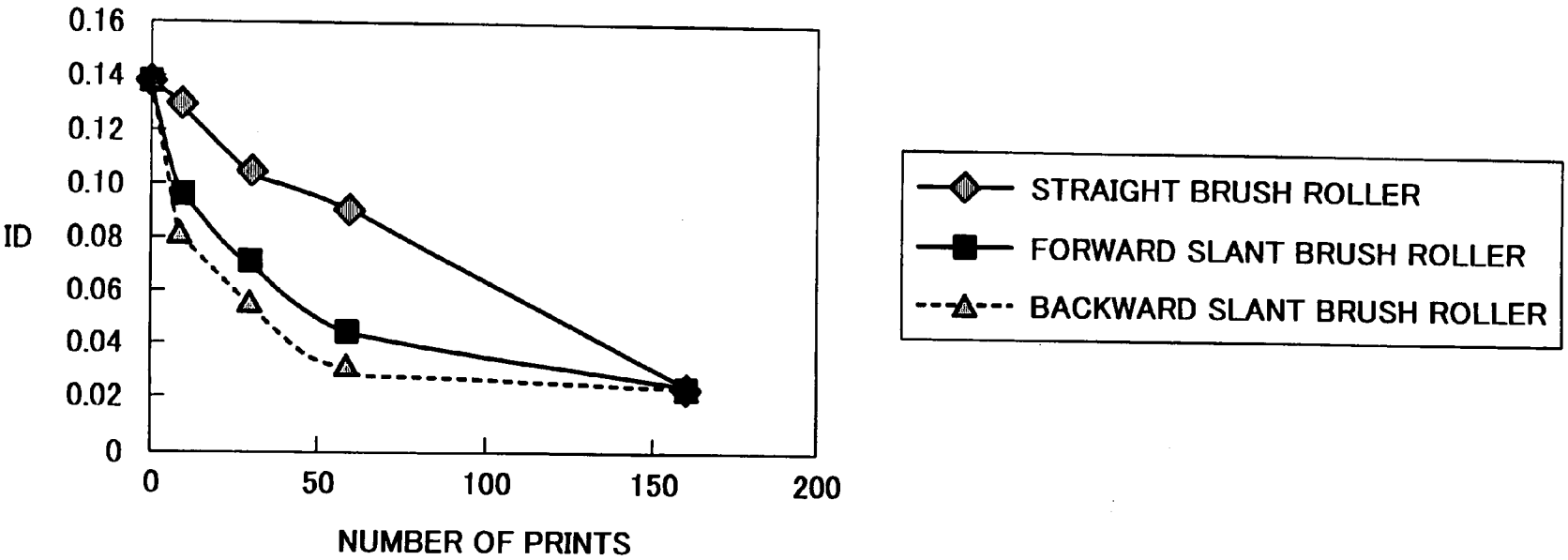
FIG. 8 is a graph showing a relationship between density of toner on a charging roller and the number of prints based on experimental results.

FIG. 8 is a graph showing a relationship between the density (ID) of toner on the charging roller 15Y and the number of prints. As seen from FIG. 8, even if the weight of the three brush rollers 162Y is nearly equal, the density of toner on the charging roller 15Y can be more decreased by using the backward slant and forward slant brush rollers 162Y than the straight brush roller 162Y. This indicates that the cleaning performance of the backward slant and forward slant brush rollers 162Y is superior to that of the straight brush roller 162Y. The reason for this is considered as follows. The leading edge of each of the filaments of the brush 161Y of the backward slant brush roller 162Y abuts the surface of the charging roller 15Y while opposing the movement of the surface of the charging roller 15Y. In this condition, as compared to the straight brush roller 162Y, the backward slant brush roller 162Y makes great impact on the toner attached onto the surface of the charging roller 15Y. When using the forward slant brush roller 162Y, not only the leading edge but also the side surface (i.e., the peripheral surface) of each of the filaments of the brush 161Y contact the surface of the charging roller 15Y, thereby increasing a contact area between the filaments of the brush 161Y and the toner attached onto the surface of the charging roller 15Y. In this condition, when the side surface of each of the filaments is away from the surface of the charging roller 15Y by the rotation of the brush roller 162Y, the toner in contact with the side surface of each of the filaments bounces when the flexed filaments are restored to their original shape. This allows the forward slant brush roller 162Y to enhance its cleaning performance.

Further, as seen from FIG. 8, it is found that the cleaning performance of the backward slant brush roller 162Y is slightly superior to that of the forward slant brush roller 162Y. Therefore, the backward slant brush roller 162Y may be preferably used in view of the cleaning performance. However, as described above, the leading edge of each of the filaments of the brush 161Y of the backward slant brush roller 162Y abuts the surface of the charging roller 15Y. In this condition, the surface of the charging roller 15Y may tend to suffer damage. For this reason, the forward slant brush roller 162Y may be preferably used in view of the fact that the reduction of the useful lifetime of the charging roller 15Y can be prevented while enhancing the cleaning performance of the brush roller 162Y.

For reference purposes, the data of density of toner on the charging roller 15Y measured after 60,000 prints were produced in the experiments is shown in Table 2.

TABLE 2

| Type of brush | Density (ID) of toner on the charging roller | | |
|---|---|---|---|
| | Left area of roller | Center area of roller | Right area of roller |
| Straight brush | 1.45 | 1.33 | 1.48 |
| Forward slant brush | 0.93 | 0.50 | 0.95 |
| Backward slant brush | 0.61 | 0.30 | 0.61 |

It is preferable that the brush 161Y is made of a conductive material rather than an insulating material, because the conductive brush 161Y exerts higher cleaning performance. The present inventor conducted experiments on cleaning performance of the backward slant brush roller 162Y made of an insulating material and the backward slant brush roller 162Y made of a conductive material. Nylon was used as the insulating material. Further, 66 nylon or triacetate in which carbon was dispersed was used as the conductive material. The conditions in this experiment other than the above were similar to the above-described conditions.

Figure 9:
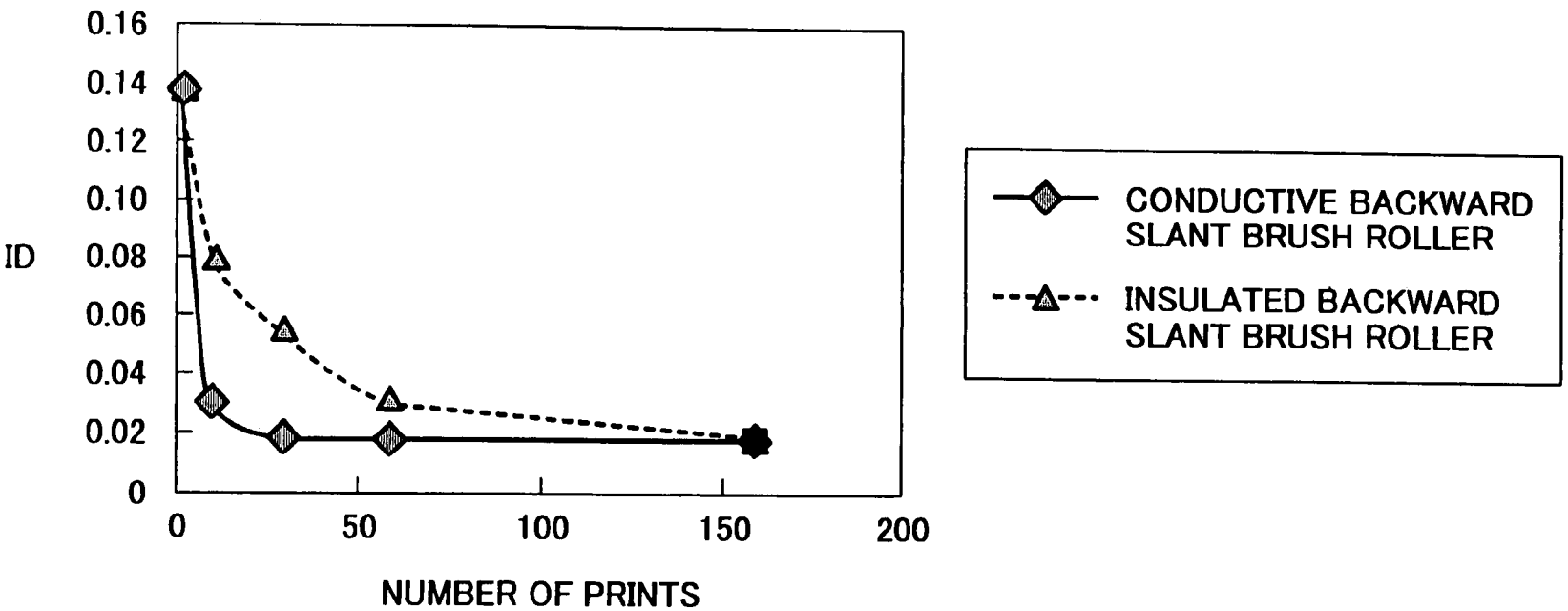
FIG. 9 is a graph showing a relationship between density of toner on a charging roller and the number of prints based on experimental results.

FIG. 9 is a graph showing a relationship between the density of toner on the charging roller 15Y and the number of prints. As seen from FIG. 9, the brush roller 162Y made of the conductive material can control the toner density at a low value over a long period of time, that is, exerts high cleaning performance.

For reference purposes, the data of density of toner on the charging roller 15Y measured after 60,000 prints were produced in the experiments is shown in Table 3.

TABLE 3

| Type of brush | Density (ID) of toner on the charging roller | | |
|---|---|---|---|
| | Left area of roller | Center area of roller | Right area of roller |
| Conductive backward slant brush | 0.35 | 0.0247 | 0.95 |
| Insulated backward slant brush | 0.61 | 0.30 | 0.61 |

It is preferable that the brush 161Y is made of the conductive material having electric resistivity of approximately $1\times10^{10}$ Ω or less. By using such a conductive material, the brush roller 162 can exert higher cleaning performance rather than an insulating material.

The laser printer according to the embodiment of the present invention is delivered from a factory in a condition such that a toner accommodating device, such as the developing device 20Y, and the toner cartridge, accommodates toner. In this laser printer, the toner is charged by friction with a polarity opposite to the polarity of the conductive brush 161Y. For example, if the brush 161Y is made of a material having a positive charging property, such as Nylon, the developing device 20Y and the toner cartridge may accommodate toner having a negative charging property for use in an image forming operation in the laser printer. When delivering this type of laser printer, the user of the laser printer is requested to use toner that is to be charged by friction with a polarity opposite to the polarity of the conductive brush 161Y. By doing so, the toner attached onto the charging roller 15Y is electrostatically adsorbed to the brush 161Y charged with a polarity opposite to the polarity of the toner, thereby enhancing the cleaning performance of the brush roller 162Y.

As a method of causing the user of the laser printer to use the above-described toner that is to be charged by friction with a polarity opposite to the polarity of the conductive brush, the toner accommodating device may accommodate such toner in advance before delivering the laser printer. Alternatively, a production number and a product name of toner may be printed on the main body of the printer or an operation manual. Alternatively, the user may be notified of a production number and a product name of toner in writing or electronic data.

Further, the toner used in the laser printer according to the embodiment of the present invention is prepared by a polymerization method. As compared to toner prepared by a pulverization method, the difference of charging amounts of toner particles between toner particles in a developer is small, so that a charging distribution of toner in a developer narrows. In this condition, the behavior of toner subjected to an electrostatic force, such as a transfer electric field, can be uniformalized, thereby enhancing electrostatic transfer efficiency. As a result, the amount of residual toner remaining on the surface of the photoreceptor 11Y, which has not been transferred onto the transfer conveying belt 60 and which has not been removed therefrom by the counter blade 13Y, can be lessened. Thus, the occurrence of an abnormal image caused by the cleaning failure of the brush roller 162Y can be lessened.

As described above, according to the embodiments of the present invention, the roller cleaning device, the image forming apparatus and the process unit including the cleaning device have a low-cost and simple configuration without a drive device for driving the brush roller of the cleaning device and a device for regulating an intrusion amount of the brush of the brush roller. This configuration controls the permanent deformation of the brush while enhancing cleaning performance of the brush roller.

The present invention has been described with respect to the exemplary embodiments illustrated in the figures. However, the present invention is not limited to these embodiments and may be practiced otherwise.

The present invention has been described with respect to a laser printer as an example of an image forming apparatus. However, the present invention may be applied to other image forming apparatuses, such as a copying machine, a facsimile machine, etc. or a multi-functional image forming apparatus.

Further, in place of the full-color laser printer, a monocolor laser printer may also be used.

Moreover, in place of a tandem-type image forming apparatus including a plurality of photoreceptors, the present invention may be applied to an image forming apparatus including one photoreceptor on which toner images of different colors are sequentially formed.

Numerous additional modifications and variations of the present invention are possible in light of the above teachings. It is therefore understood that within the scope of the appended claims, the present invention may be practiced other than as specifically described herein.

What is claimed:

1. A cleaning device, comprising:

a brush roller configured to rotate and to remove deposit from a surface of a member to be cleaned by following a movement of the surface of the member, the brush roller including a rotary shaft element and a brush provided on the rotary shaft element, wherein, the brush is configured to abut the surface of the member due to a weight of the brush roller, the brush includes filaments, and the brush roller satisfies $Y/X \leqq 2.8$, Y being a diameter of each of the filaments in units of denier, and X being a length of each of the filaments in units of millimeters, wherein the brush is provided on the rotary shaft element such that each of the filaments of the brush slants relative to a normal direction of the rotary shaft element.

2. The cleaning device according to claim 1, wherein the length of each of the filaments is less than or equal to approximately 2 mm.

3. The cleaning device according to claim 1, wherein a density of the filaments is at least approximately 10,000 filaments per square-centimeter.

4. The cleaning device according to claim 1, wherein the brush is made of a conductive material.

5. The cleaning device according to claim 4, wherein the brush has an electric resistivity of approximately $1\times10^{10}$ Ω or less.

6. The cleaning device according to claim 1, wherein the brush is provided on the rotary shaft element such that each of the filaments of the brush slants to an upstream side relative to the normal direction in a moving direction of the surface of the member.

7. The cleaning device according to claim 1, wherein the brush is provided on the rotary shaft element such that each of the filaments of the brush slants to a downstream side relative to the normal direction in a moving direction of the surface of the member.

8. An image forming apparatus, comprising:

an image carrier configured to carry an image on a surface of the image carrier;

a charging member configured to charge the surface of the image carrier while contacting the surface of the image carrier;

a toner image forming device configured to form a toner image on the surface of the image carrier by use of toner; and a cleaning device configured to remove toner attached to a surface of the charging member, the cleaning device including, a brush roller configured to rotate by following a movement of the surface of the charging member, the brush roller including a rotary shaft element and a brush provided on the rotary shaft element, wherein, the brush is configured to abut the surface of the charging member due to a weight of the brush roller, the brush includes filaments, and the brush roller satisfies $Y/X \leqq 2.8$, Y being a diameter of each of the filaments in units of denier, and X being a length of each of the filaments in units of millimeters, wherein the brush is provided on the rotary shaft element such that each of the filaments of the brush slants relative to a normal direction of the rotary shaft element.

9. The image forming apparatus according to claim 8, wherein the length of each of the filaments is less than or equal to approximately 2 mm.

10. The image forming apparatus according to claim 8, wherein a density of the filaments is at least approximately 10,000 filaments per square-centimeter.

11. The image forming apparatus according to claim 8, wherein the brush is made of a conductive material.

12. The image forming apparatus according to claim 11, wherein the brush has an electric resistivity of approximately $1\times10^{10}$ Ω or less.

13. The image forming apparatus according to claim 8, wherein the brush is provided on the rotary shaft element such that each of the filaments of the brush slants to an upstream side relative to the normal direction in a moving direction of the surface of the charging member.

14. The image forming apparatus according to claim 8, wherein the brush is provided on the rotary shaft element such that each of the filaments of the brush slants to a downstream side relative to the normal direction in a moving direction of the surface of the charging member.

15. The image forming apparatus according to claim 8, further comprising:

a toner accommodating device configured to accommodate the toner used for forming the toner image on the image carrier, wherein the brush of the brush roller is made of a conductive material and is charged with a predetermined polarity, and wherein the toner is charged by friction with a polarity opposite to the predetermined polarity of the brush.

16. The image forming apparatus according to claim 8, wherein the brush of the brush roller is made of a conductive material and is charged with a predetermined polarity, and wherein the toner used for forming the toner image on the image carrier is charged by friction with a polarity opposite to the predetermined polarity of the brush.

17. The image forming apparatus according to claim 8, wherein the toner used for forming the toner image on the image carrier is prepared by a polymerization method.

18. A process unit for use in an image forming apparatus including a developing device, the process unit comprising:

a latent image carrier configured to carry a latent image on a surface of the latent image carrier, wherein the developing device is configured to develop the latent image on the latent image carrier with toner;

a member that contacts the surface of the latent image carrier;

a cleaning device configured to remove toner attached to a surface of the member, the cleaning device including, a brush roller configured to rotate by following a movement of the surface of the member, the brush roller including a rotary shaft element and a brush provided on the rotary shaft element, wherein, the brush is configured to abut the surface of the member due to a weight of the brush roller, the brush includes filaments, and the brush roller satisfies $Y/X \leqq 2.8$, Y being a diameter of each of the filaments in units of denier, and X being a length of each of the filaments in units of millimeters, wherein the brush is provided on the rotary shaft element such that each of the filaments of the brush slants relative to a normal direction of the rotary shaft element.

19. The process unit according to claim 18, wherein the length of each of the filaments is less than or equal to approximately 2 mm.

20. The process unit according to claim 18, wherein a density of the filaments is at least approximately 10,000 filaments per square-centimeter.

21. The process unit according to claim 18, wherein the brush is made of a conductive material.

22. The process unit according to claim 21, wherein the brush has an electric resistivity of approximately $1\times10^{10}$ Ω or less.

23. The process unit according to claim 18, wherein the brush is provided on the rotary shaft element such that each of the filaments of the brush slants to an upstream side relative to the normal direction in a moving direction of the surface of the member.

24. The process unit according to claim 18, wherein the brush is provided on the rotary shaft element such that each of the filaments of the brush slants to a downstream side relative to the normal direction in a moving direction of the surface of the member.

25. A method of removing deposit from a surface of a member, comprising:

abutting a brush, which is provided on a rotary shaft element of a brush roller, against the surface of the member due to a weight of the brush roller;

rotating the brush roller by moving the surface of the member relative to the brush, wherein the brush includes filaments, and the brush roller satisfies $Y/X \leqq 2.8$, Y being a diameter of each of the filaments in units of denier, and X being a length of each of the filaments in units of millimeters, and providing the brush on the rotary shaft element such that each of the filaments of the brush slants relative to a normal direction of the rotary shaft element.

26. The method of according to claim 25, further comprising:

providing the brush on the rotary shaft element such that each of the filaments of the brush slants to an upstream side relative to the normal direction in a moving direction of the surface of the member.

27. The method of according to claim 25, further comprising:

providing the brush on the rotary shaft element such that each of the filaments of the brush slants to a downstream side relative to the normal direction in a moving direction of the surface of the member.

28. A method of forming an image, comprising:

charging a surface of an image carrier by contacting a charging member to the surface of the image carrier;

forming a toner image on the surface of the image carrier;

removing toner attached to a surface of the charging member by abutting a brush, which is provided on a rotary shaft element of a brush roller, against the surface of the charging member due to a weight of the brush roller and by rotating the brush roller with a movement of the surface of the charging member, wherein the brush includes filaments, and the brush roller satisfies $Y/X \leqq 2.8$, Y being a diameter of each of the filaments in units of denier, and X being a length of each of the filaments in units of millimeters, and providing the brush on the rotary shaft element such that each of the filaments of the brush slants relative to a normal direction of the rotary shaft element.

29. The method of according to claim 28, further comprising:

providing the brush on the rotary shaft element such that each of the filaments of the brush slants to an upstream side relative to the normal direction in a moving direction of the surface of the charging member.

30. The method of according to claim 28, further comprising:

providing the brush on the rotary shaft element such that each of the filaments of the brush slants to a downstream side relative to the normal direction in a moving direction of the surface of the charging member.

31. A cleaning device, comprising:

brush means for removing deposit from a surface of a member to be cleaned while rotating due to a movement of the surface of the member; and supporting means for supporting and allowing rotation of the brush means, wherein, the brush means abuts the surface of the member due to a weight of the supporting means and the brush means when the cleaning device is positioned at the member, the brush means includes filaments, and the brush means satisfies $Y/X \leqq 2.8$, Y being a diameter of each of the filaments in units of denier, and X is a length of each of the filaments in units of millimeters, wherein the brush is provided on the rotary shaft element such that each of the filaments of the brush slants relative to a normal direction of the rotary shaft element.

32. An image forming apparatus, comprising:

an image carrier configured to carry an image on a surface of the image carrier;

a charging member configured to charge the surface of the image carrier while contacting the surface of the image carrier;

a toner image forming device configured to form a toner image on the surface of the image carrier by use of toner; and removing means for removing toner attached to a surface of the charging member, the removing means including, brush means for contacting the surface of the charging member and for rotating due to a movement of the surface of the charging member, and supporting means for supporting the brush means, wherein, the brush means abuts the surface of the charging member due to a weight of the supporting means and the brush means when the removing means is positioned at the charging member, the brush means includes filaments, and the brush means satisfies Y/X 2.8, Y being a diameter of each of the filaments in units of denier, and X being a length of each of the filaments in units of millimeters, wherein the brush means is provided on the rotary shaft element such that each of the filaments of the brush means slants relative to a normal direction of the rotary shaft element.

33. The image forming apparatus according to claim 32, further comprising:

a toner accommodating device configured to accommodate the toner used for forming the toner image on the image carrier, wherein the brush means includes a conductive material and is charged with a predetermined polarity, and wherein the toner is charged by friction with a polarity opposite to the predetermined polarity of the brush means, wherein the brush means is provided on the rotary shaft element such that each of the filaments of the brush means slants relative to a normal direction of the rotary shaft element.

34. A process unit for use in an image forming apparatus including a developing device, the process unit comprising:

a latent image carrier configured to carry a latent image on a surface of the latent image carrier, wherein the developing device is configured to develop the latent image on the latent image carrier with toner;

a member that contacts the surface of the latent image carrier;

removing means for removing toner attached to a surface of the member, the removing means including, brush means for contacting the surface of the member and for rotating due to a movement of the surface of the member, and supporting means for supporting the brush means, wherein, the brush means abuts the surface of the member due to a weight of the supporting means and the brush means when the removing means is positioned at the member, the brush means includes filaments, and the brush means satisfies Y/X 2.8, Y being a diameter of each of the filaments in units of denier, and X being a length of each of the filaments in units of millimeters, wherein the brush means is provided on the rotary shaft element such that each of the filaments of the brush means slants relative to a normal direction of the rotary shaft element.

* * * * *